US010663253B1

(12) United States Patent
Geissele et al.

(10) Patent No.: US 10,663,253 B1
(45) Date of Patent: May 26, 2020

(54) FOLDABLE IRON SIGHT ASSEMBLY FOR A FIREARM

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/244,298

(22) Filed: Jan. 10, 2019

(51) Int. Cl.
*F41G 1/16* (2006.01)
*F41G 11/00* (2006.01)
*F41G 1/08* (2006.01)

(52) U.S. Cl.
CPC ..... *F41G 1/16* (2013.01); *F41G 1/08* (2013.01); *F41G 11/003* (2013.01)

(58) Field of Classification Search
CPC ..... F41G 1/02; F41G 1/06; F41G 1/08; F41G 1/16; F41G 1/22; F41G 11/003
USPC ..... 42/111, 133, 135, 136, 137, 138, 139, 42/140, 148
See application file for complete search history.

(56) References Cited

U.S. PATENT DOCUMENTS

| | | | | |
|---|---|---|---|---|
| 2,494,163 | A * | 1/1950 | Davis | F41G 1/26 42/137 |
| 8,276,307 | B2 * | 10/2012 | Deros | F41G 11/003 42/127 |
| 9,733,045 | B1 * | 8/2017 | Bozek | F41G 1/16 |
| 10,119,784 | B1 * | 11/2018 | Ding | F41G 1/033 |
| 2004/0226213 | A1 * | 11/2004 | Woodbury | F41G 1/033 42/140 |
| 2011/0308133 | A1 * | 12/2011 | Nemec | F41G 1/16 42/137 |
| 2015/0198414 | A1 * | 7/2015 | Raybman | F41G 1/17 42/111 |
| 2016/0102941 | A1 * | 4/2016 | Brucker | F41G 1/17 42/148 |
| 2016/0341503 | A1 * | 11/2016 | Langevin | F41G 1/033 |

* cited by examiner

*Primary Examiner* — Bret Hayes
(74) *Attorney, Agent, or Firm* — Fox Rothschild LLP

(57) ABSTRACT

The disclosure relates to a foldable iron sight assembly for a firearm that includes a rail mount including a base, a clamp, a rail pin, and a base locking portion; a windage or elevation sight member that includes a sight member locking portion rotatably connected to the base locking portion, wherein the base locking portion and the sight member locking portion are configured to interlock with each other; and a locking mechanism that includes an axle and a biasing element, wherein the sight member is rotatable between a locked raised position and a locked lowered position when a force applied to the sight member compresses the biasing element. Also disclosed is a firearm having a rail to which the assembly is secured, and a method of operating the assembly.

18 Claims, 5 Drawing Sheets

FOLDABLE IRON SIGHT ASSEMBLY FOR A FIREARM

BACKGROUND

Virtually all firearms are equipped with some type of sighting system to facilitate aiming the weapon. Examples of typical sighting systems include telescopic sights, holographic sights, laser sights, and iron sights. Iron sights, sometimes referred to as open sights or back up iron sights, include a front sight and a rear sight through which the firearm user aligns his/her line of sight with a desired target. Many iron sights are fixed or adjustable. Fixed iron sights can be integrally machined into the firearm, whereas adjustable iron sights can be adjusted for elevation (vertical adjustment) or windage (horizontal adjustment).

It is critical to not only properly adjust the sights with respect to the desired target, but also to maintain that precise adjustment each time the weapon is fired. Even a very small deviation in the positioning of the sights will result in the fired projectile having a trajectory that diverges from the intended target relative to the distance from that target. Thus, there is a need for iron sights that are highly durable, stable, precise, and secure, particularly for use in combat or environments where the weapon may be subject to impact or rough handling conditions.

SUMMARY

The disclosed technology generally relates to a foldable iron sight assembly that may be mounted to a rail of a firearm and includes a sight member that is rotatable between a locked raised position and a locked lowered position. The disclosed assembly provides a highly durable, stable, precise, and secure iron sight that can be reliably used in a variety of situations, including combat or environments where the firearm may be subjected to impact or rough handling conditions.

In one aspect, the disclosed technology relates to a foldable iron sight assembly for a firearm, including: a rail mount including a base, a clamp, a rail pin, and a base locking portion; a sight member including a sight member locking portion rotatably connected to the base locking portion, wherein the base locking portion and the sight member locking portion are configured to interlock with each other; and a locking mechanism including an axle and a biasing element, wherein the sight member is rotatable between a locked raised position and a locked lowered position when a force applied to the sight member compresses the biasing element. In one embodiment, the base locking portion includes a slot configured to receive a lower portion of a slot pin, wherein the slot aligns with a hole that extends longitudinally into a lower end of the sight member and is configured to receive an upper portion of the slot pin. In another embodiment, the biasing element is positioned between a side of the sight member locking portion and an inner surface of the base locking portion. In another embodiment, the biasing element is a spring. In another embodiment, the spring has a compression force of about 7 pounds to about 11 pounds. In another embodiment, the rail pin and the clamp are configured to secure the base to a rail of a firearm. In another embodiment, the rail pin is a rounded pin. In another embodiment, the base includes a rail holder portion configured to align with a portion of the rail below the groove. In another embodiment, when the assembly is mounted on a rail of a firearm, at least a portion of the rail pin is positioned within a first groove of the rail. In another embodiment, the rail mount further includes a stopper configured to fit within an aperture of the base, and wherein when the assembly is mounted on a rail of a firearm, at least a portion of the stopper is positioned within a second consecutive groove of the rail. In another embodiment, the sight member is selected from a windage sight member and an elevation sight member. In another embodiment, the windage sight member includes a horizontally adjustable windage component. In another embodiment, the elevation sight member includes a vertically adjustable elevation component.

In another aspect, the disclosed technology relates to a firearm including a disclosed foldable iron sight assembly.

In another aspect, the disclosed technology relates to a method of operating a foldable backup iron sight assembly for a firearm, including: (a) securing an assembly of claim 1 to a rail of a firearm; (b) applying a force to a side of the sight member in order to compress the biasing element and unlock the sight member; and (c) rotating the unlocked sight member to a raised or lowered locked position. In one embodiment, step (b) includes applying a force of about 7 pounds to about 11 pounds.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Various non-limiting embodiments will be described in detail with reference to the drawings, wherein like reference numerals represent like parts and assemblies throughout the several views.

DETAILED DESCRIPTION

The present disclosure generally relates to a foldable iron sight assembly. References to various embodiments and examples set forth in this specification do not limit the scope of the disclosure and merely set forth some of the many possible embodiments of the appended claims.

The disclosed foldable iron sight assembly may contain front and rear sights that can be separately attached to a firearm (e.g., to the firearm rail) or can include components that are manufactured as part of the firearm (e.g., the firearm rail) and integrally formed therewith. The sights of the iron sight assembly can advantageously fold down to both protect the sight and provide a lower profile when the sights are not needed by the user. The sights of the iron sight assembly can also unfold or flip up when needed by the user, such as when a primary sighting system becomes damaged, unavailable or otherwise fails.

Figure 1:
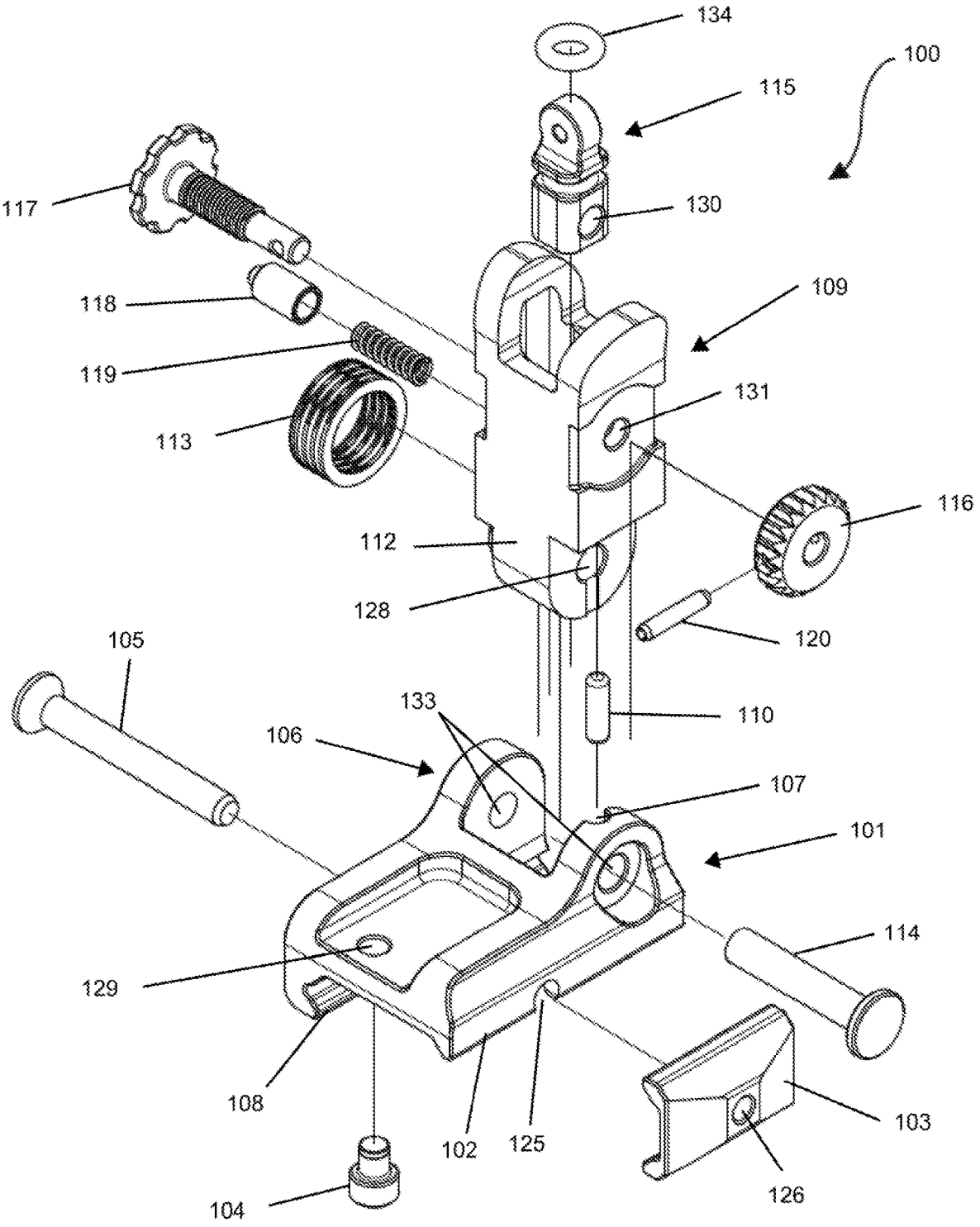
FIG. 1 shows an exploded view of an example folding iron sight assembly containing a windage sight member.
Figure 2:
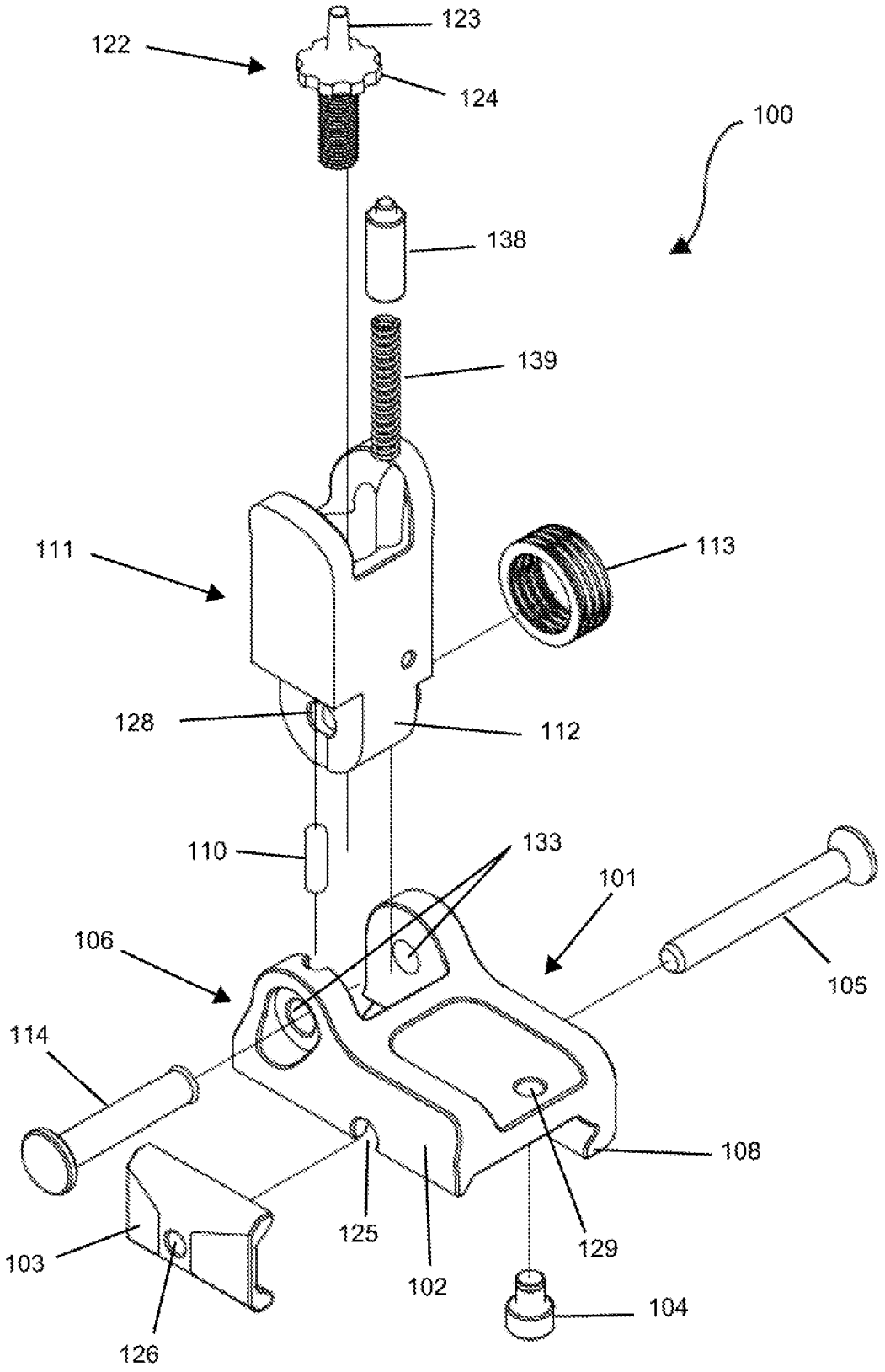
FIG. 2 shows an exploded view of an example folding iron sight assembly containing an elevation sight member.

FIGS. 1-2 show an example foldable iron sight assembly 100 that includes a rail mount 101 having a base 102, a clamp 103, a stopper 104, and a rail pin 105, wherein the base contains a base member locking portion 106. The rail mount 101 can be mounted to a firearm rail such as, for example, a Picatinny style mounting platform known as a Picatinny rail or a MIL-STD-1913. As used herein, the term "pin" (e.g., rail pin, slot pin, etc.) refers to a round pin, a screw, square pin, flat pin, solid cylindrical pin, tapered pin, groove pin, spring pin, or any other shaped component or structure that would serve the relevant purpose described herein.

In some embodiments, when the foldable iron sight assembly 100 is mounted on the rail of a firearm, at least a portion of the rail pin 105 is snugly positioned within a groove of the rail of the firearm to hold the rail mount 101 in place. As shown in FIGS. 1-2, the clamp 103 includes an aperture 126, and the base 102 includes apertures 125 on each side of the base 102. These apertures 125, 126 align when the iron sight assembly 100 is mounted on a rail. In some embodiments, the rail pin 105 is sized to fit within and through the aperture 125 on one side of the base 102 of the rail mount, extend across the underside of the base 102, fit into and through the aperture 125 on the opposite side of the base 102, and then fit into the aperture 126 of the clamp 103. The rail pin 105 can be secured in the aperture 126 of the clamp 103 by a press fit, threaded connection, or other style connection. The base 102 of the rail mount 101 may also include a rail holder portion 108 that aligns with an outer portion of the rail below the groove in order to further secure the rail mount 101 to a rail. In one embodiment, the rail pin 105, rail holder portion 108, base 102, and clamp 103 collectively secure the iron sight assembly to the rail of a firearm.

Additionally, to further secure the base 102 of the rail mount 101 to a rail, a stopper 104 can be sized to fit within an aperture 129 of the base and to also snugly fit within a groove of the rail consecutive to the groove within which the rail pin 105 is snugly positioned. The stopper 104 can have a variety of shapes and sizes configured to fit into the aperture 129 of the base and to also snugly fit into a groove of the rail. The apertures in the clamp 103 and base 102 of the rail mount 101, and the rail pin 105 can have a variety of corresponding sizes and shapes (e.g., rounded) so long as they are collectively configured to align and serve the purpose described herein.

FIG. 1 shows the foldable iron sight assembly 100 having a windage sight member 109 with a sight member locking portion 112. FIG. 2 shows the foldable iron sight assembly 100 having an elevation sight member 111 with a sight member locking portion 112.

The sight member locking portion 112 is configured to interlock with the base locking portion 106 so as to couple the windage sight member 109 (or elevation sight member 111) to the rail mount 101. In some embodiments, the windage sight member 109 is rotatably connected to the base locking portion 106 of the rail mount 101 via a locking mechanism, such as a spring assisted locking mechanism (discussed below). The locking mechanism can be configured to rotate the sight member (windage sight member 109 or elevation sight member 111) between raised and lowered positions. For example, when the sight member is in a raised locked position, a force may be applied to the locking mechanism that unlocks the sight member and allows it to be rotated to a lowered locked position. Similarly, when the sight member is in a lowered locked position, a force may be applied to the locking mechanism that unlocks the sight member and allows it to be rotated to a raised locked position.

In some embodiments the locking mechanism is a spring assisted locking mechanism that includes a biasing element 113 and an axle 114. As shown in FIGS. 1-2, the biasing element 113 is a spring, but any other biasing structure that would serve the same purpose as described herein could be used as an alternative. In some embodiments, the biasing element 113 is a spring having a desired spring force. For example, the desired spring force may be about 7 pounds to about 11 pounds, such as about 8 pounds to about 10 pounds, or about 9 pounds.

As shown in FIGS. 1-2, the axle 114 is shaped as a cylindrical body having two circular ends. The smaller-diameter, or second end is formed after the axle 114 has been installed in the base locking portion 106. In one embodiment, the second end, prior to installation, has a diameter matching that of the axle body. This feature permits the second end to be inserted through apertures 133 formed in first and second protruding portions on opposite sides of the base locking portion 106. Once the axle 114 has been inserted, the second end is deformed by peening or another suitable process into a form, depicted in FIGS. 1-2, in which the second end has a diameter larger than that of the apertures 133. Once deformed, the second end, along with the larger-diameter first end, which also has a diameter larger than that of the apertures 133, retains the axle 114 on the base locking portion 106.

In alternative embodiments of the present disclosure, the first and second ends of the axle 114 can be formed in non-cylindrical and/or non-circular shapes that would serve the same retaining purpose described herein. In the embodiment depicted in FIGS. 1-2, the diameter of the first end is larger than that of the second end after the second end has been deformed. The respective diameters of the first and second ends can be the same in other alternative embodiments.

The axle 114 is not removable after the second end has been deformed. In alternative embodiments, the axle 114 can be retained in a manner that permits the axle 114 to be removed. For example, the axle 114 can be formed with threads that permit the axle 114 to mate with a bolt or other feature that prohibits the axle 114 from backing out of the apertures 133.

The sight member locking portion 112 includes a through hole 128 positioned perpendicular to a longitudinal axis of the windage sight member 109 or the elevation sight member 111. Through hole 128 may be positioned in a lower one-third portion of the sight member (windage sight member 109 or elevation sight member 111). When assembled, through hole 128 aligns with the apertures 133 of the first and second protruding portions on opposite sides of the base locking portion 106. The sight member locking portion 112 and the biasing element 113 are configured to fit within a space between the first and second protruding portions of the base locking portion 106, at a distal end of base 102. The body of the axle 114 rotatably connects the base locking portion 106 to the sight member locking portion 112. When assembled, the axle 114 extends through the following components: the first aperture 133 of the first protruding portion of the base locking portion 106, the biasing element 113, the through hole 128 of the sight member locking portion 112, and the second aperture 133 of the second protruding portion on the opposite side of the base locking portion 106.

In some embodiments, the locking mechanism further includes a slot pin 110. In this embodiment, the base locking portion 106 includes a first slot 107 that receives the slot pin 110 and that aligns the slot pin 110 in a hole extending longitudinally into a lower end of the sight member in order to lock the sight member in a raised position. In the raised locked position, the slot pin is positioned generally perpendicular to a longitudinal axis of the base 102. The base locking portion 106 may also include a second slot (not shown) that similarly receives the slot pin 110 and aligns with the hole extending longitudinally into the lower end of the sight member in order to lock the sight member in a lowered position. In the lowered locked position, the slot pin is positioned generally parallel to a longitudinal axis of the base 102.

To rotate the sight member assembly 109 between locked positions, the user applies a force to the side of the sight member assembly 109 opposite the biasing element 113, which compresses the biasing element 113 and unseats the slot pin 110 from the relevant slot. The sight member assembly 109 may then be rotated, and once the desired rotation is complete (e.g., once the sight member rotates about 80° to about 100°, such as about 90°, from its initial locked position), the slot pin 110 will align with and be seated within the relevant slot, thereby locking the sight member in the new locked position.

As shown in FIG. 1, windage sight member 109 includes a horizontally adjustable windage component 115 having a central aperture, a knob 116, and an adjustment screw 117. This central aperture can be a partial or complete aperture of any desired size and shape (e.g., circular, semi-circular, triangular, V-shaped, etc.). In some embodiments, the windage component 115 includes a through hole 130 positioned perpendicular to a longitudinal axis of the windage component 115. Through hole 130 may generally be positioned within or near a lower one-third portion of the windage component 115. The windage sight member 109 may include a through hole 131 positioned perpendicular to a longitudinal axis of the windage sight member 109. Through hole 131 may be positioned in a middle one-third portion of the windage sight member 109. When assembled, through hole 130 aligns with through hole 131. The windage sight member 109 may further include an O-ring seal 134 to seal the interface between the windage component 115 and the sight member locking portion 112.

An adjustment screw 117 (e.g., a threaded adjustment screw) is configured to extend through the through hole 131 of the windage sight member 109 and the through hole 130 of the windage component 115, where the end of the adjustment screw is secured to knob 116 via pin 120. The adjustment screw and knob may be secured in place until adjustment is needed. For example, as shown in FIG. 1, the windage sight member 109 may optionally include a spring loaded plunger 118 having a projection that is shaped to fit within any of a plurality of recesses along the outer circumference of the head of the adjustment screw 117. The projection prevents the adjustment screw 117 from rotating until the knob 116 is rotated. A portion of the plunger 118 that contacts the head of the adjustment screw 117 is tapered in a manner that causes the contacting surface of the adjustment screw 117 to urge the plunger 118 inwardly, against the bias of its biasing spring 119, when the user exerts a sufficient amount of torque on the adjustment screw 117 by rotating the attached knob 116. More specifically, the windage component 115 may be adjusted by a turning motion involving the adjustment screw 117 and the knob 116, which causes the plunger 138 to back out of its associated recess in the adjustment screw 117 and thereby permits the adjustment screw 117 and the knob 116 to rotate; and the windage component 115 may be secured in place by the adjustment screw 117 and spring loaded plunger 118 before and after adjustment.

As shown in FIG. 2, elevation sight member 111 includes a vertically adjustable elevation component 122 having a post 123 and a knob 124. The knob 124 can be either separate from or integrally formed with the post 123. The post 123 can be of any desired size and shape (e.g., cylindrical, tapered, etc.). In some embodiments, the elevation component comprises external threads that match corresponding internal threads of a hole extending longitudinally into the upper end of the elevation sight member 111.

The knob 124 may be secured in place until adjustment is needed. For example, as shown in FIG. 2, the elevation sight member 111 may optionally include a spring loaded plunger 138 having a projection that is shaped to fit within any of a plurality of recesses along the outer circumference of the head of the knob 124. The projection prevents the knob 124 from rotating until the plunger 138 is depressed, which separates the projection from the recess and allows for ease of turning the knob 124. A portion of the plunger 138 that contacts the head of the knob 124 is tapered in a manner that causes the contacting surface of the knob 124 to urge the plunger 138 downward, against the bias of its biasing spring 139, when the user exerts a sufficient amount of torque on the knob 124 by turning the post 123.

In the disclosed embodiment, the position of the elevation component 122 can be vertically adjusted by rotating the knob 124 clockwise or counterclockwise. More specifically, the elevation component 122 may be adjusted by exerting a torque on the post 123, which causes the plunger 138 to back out of its associated recess in the knob 124 and thereby permits the knob 124 to rotate; and the elevation component 122 may be secured in place by the knob 124 and spring loaded plunger 138 before and after adjustment.

Figure 3A:
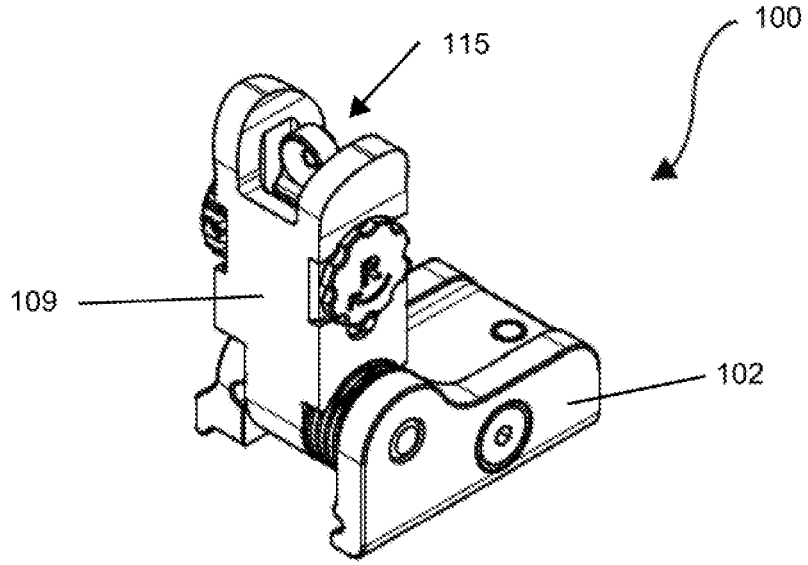
FIG. 3A shows an example folding iron sight assembly containing a windage sight member in a locked raised position.
Figure 3B:
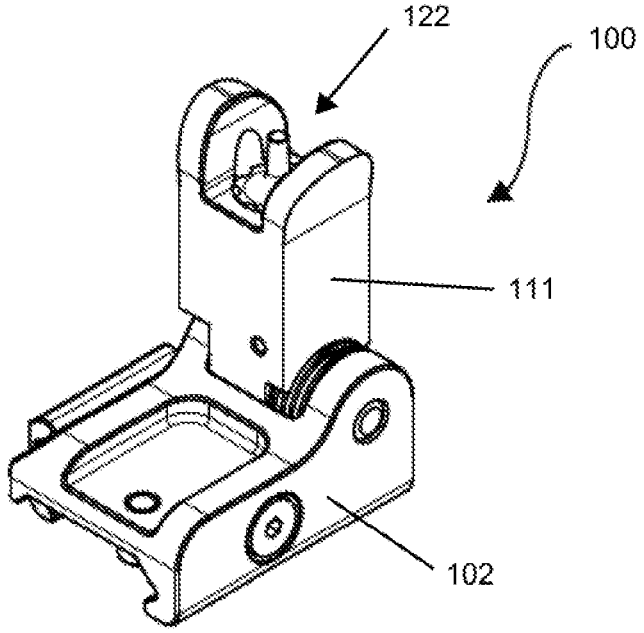
FIG. 3B shows an example folding iron sight assembly containing an elevation sight member in a locked raised position.
Figure 4A:
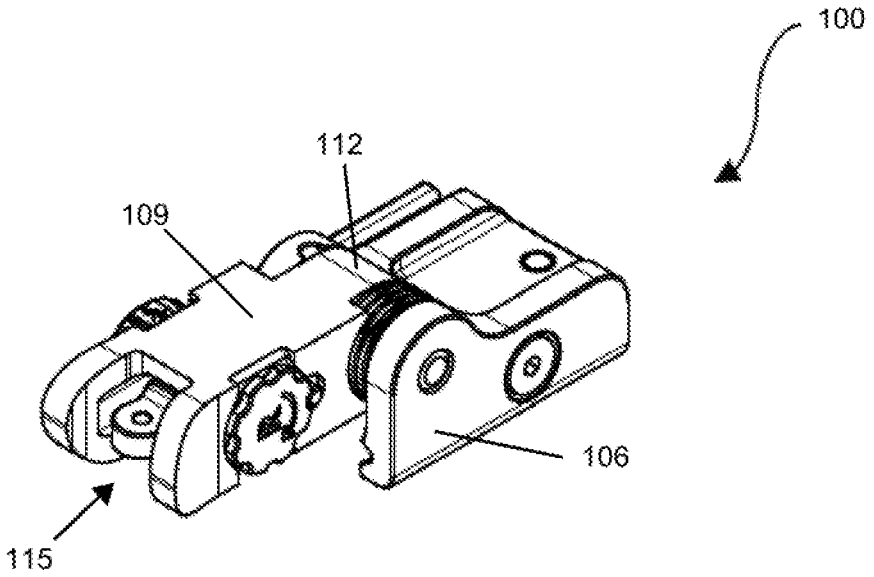
FIG. 4A shows an example folding iron sight assembly containing a windage sight member in a locked lowered position.
Figure 4B:
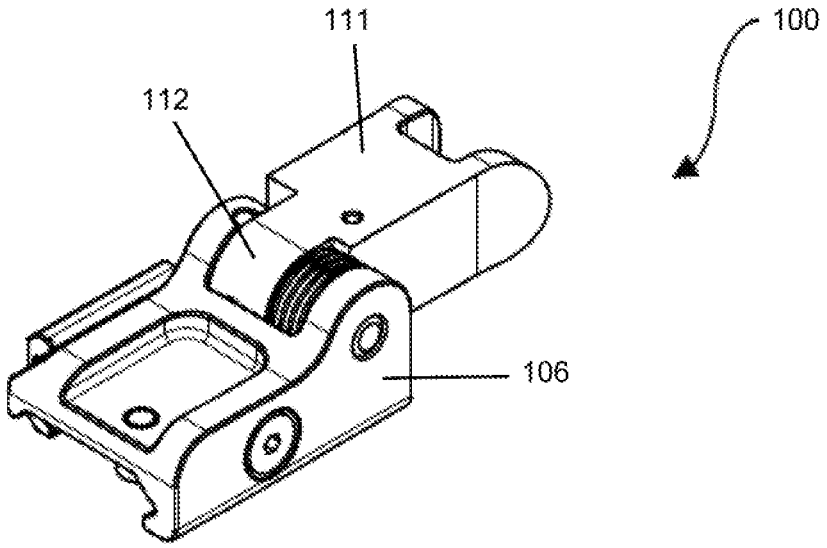
FIG. 4B shows an example folding iron sight assembly containing an elevation sight member in a locked lowered position.

FIG. 3A shows an example of a foldable iron sight assembly 100 having a windage sight member 109 and FIG. 3B shows an example of a foldable iron sight assembly 100 having an elevation sight member 111, each in a locked raised position, wherein each sight member is generally perpendicular to a longitudinal axis of its base. FIG. 4A shows an example of a foldable iron sight assembly 100 having a windage sight member 109 and FIG. 4B shows an example of a foldable iron sight assembly 100 having an elevation sight member 111, each in a locked lowered position, wherein each sight member is generally parallel to a longitudinal axis of its base. While these examples show the foldable iron sight assembly in two different locked positions, some embodiments of the foldable iron sight assembly may have more than two different locked positions.

Figure 5:
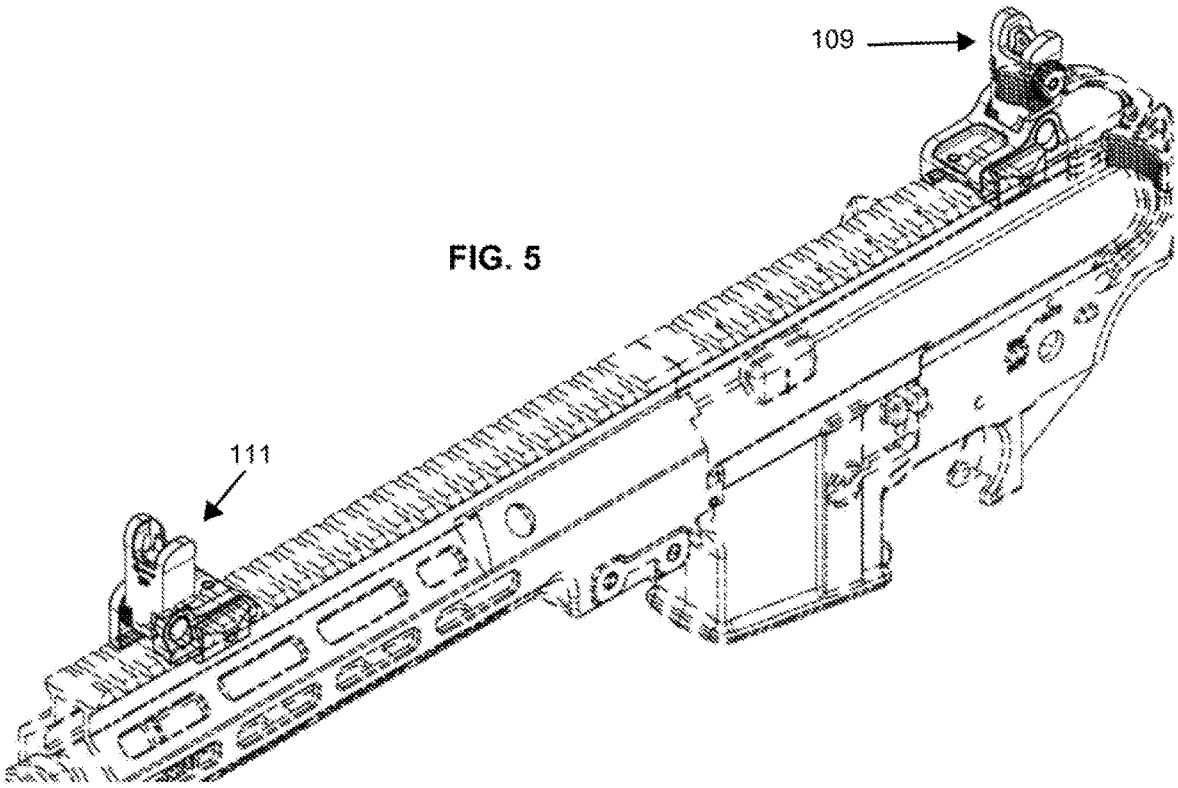
FIG. 5 shows an example firearm including a foldable iron sight assembly in a locked raised position.
Figure 6:
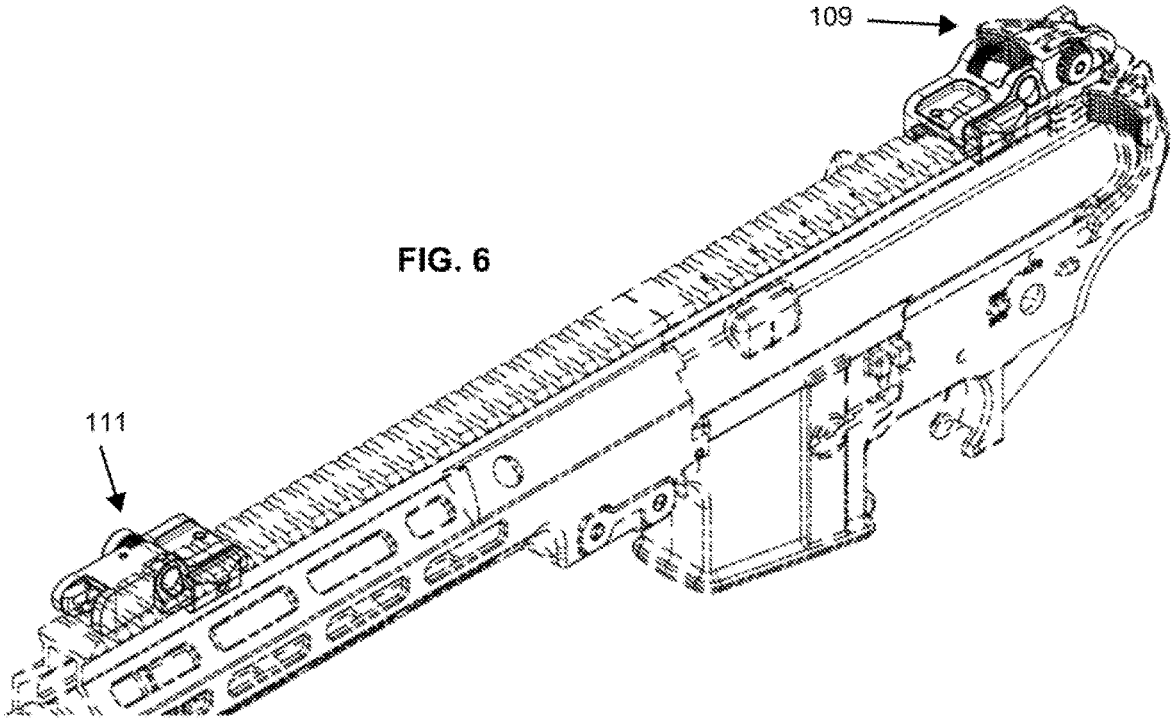
FIG. 6 shows an example firearm including a foldable iron sight assembly in a locked lowered position.

FIG. 5 shows an example of a foldable iron sight assembly 100 having a windage sight member 109 and a foldable iron sight assembly 100 having an elevation sight member 111, each in a locked raised position and securely attached to a firearm rail. FIG. 6 shows an example of a foldable iron sight assembly 100 having a windage sight member 109 and a foldable iron sight assembly 100 having an elevation sight member 111, each in a locked lowered position and securely attached to a firearm rail. In FIGS. 5-6, the foldable iron sight assembly 100 having a windage sight member 109 is attached to a proximal end of the rail, closest to the firearm user. In some embodiments, only a foldable iron sight assembly 100 having a windage sight member 109 or a foldable iron sight assembly 100 having an elevation sight member 111 is attached to a rail. In other embodiments, both may be attached to a rail.

Methods for operating a foldable iron sight assembly using the above disclosed embodiments of the foldable iron sight assembly are provided. In some embodiments, the method includes securing a foldable iron sight assembly disclosed herein to a rail of a firearm. The assembly may be secured to the rail while in the locked lowered or locked raised position. Once secured to the rail, the relevant sight member of the foldable iron sight assembly may be raised or lowered using a locking mechanism such as a spring assisted locking mechanism as described above.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A foldable iron sight assembly for a firearm having a rail with grooves, comprising:

a rail mount comprising a base, a clamp, a rail pin, and a base locking portion;

a sight member having a first side and a second side opposite the first side and comprising a sight member locking portion rotatably connected to the base locking portion, wherein the base locking portion and the sight member locking portion are configured to interlock with each other; and a locking mechanism comprising an axle and a biasing element interposed between a portion of the rail mount and the first side of the sight member, wherein the sight member is rotatable between a locked raised position and a locked lowered position when a force applied to the second side of the sight member compresses the biasing element.

2. The assembly of claim 1, wherein the base locking portion comprises a slot configured to receive a lower portion of a slot pin, wherein the slot aligns with a hole that extends longitudinally into a lower end of the sight member and is configured to receive an upper portion of the slot pin.

3. The assembly of claim 1, wherein the biasing element is positioned between a side of the sight member locking portion and an inner surface of the base locking portion.

4. The assembly of claim 1, wherein the biasing element is a spring.

5. The assembly of claim 4, wherein the spring has a compression force of about 7 pounds to about 11 pounds.

6. The assembly of claim 1, wherein the rail pin and the clamp are configured to secure the base to a rail of a firearm.

7. The assembly of claim 1, wherein the rail pin is a rounded pin.

8. The assembly of claim 1, wherein the base comprises a rail holder portion configured to align with a portion of the rail below at least one of the grooves.

9. The assembly of claim 1, wherein when the assembly is mounted on a rail of a firearm, at least a portion of the rail pin is positioned within a first groove of the rail.

10. The assembly of claim 9, wherein the rail mount further comprises a stopper configured to fit within an aperture of the base, and wherein when the assembly is mounted on a rail of a firearm, at least a portion of the stopper is positioned within a second consecutive groove of the rail.

11. The assembly of claim 1, wherein the sight member is selected from a windage sight member and an elevation sight member.

12. The assembly of claim 1, wherein the sight member comprises a horizontally adjustable windage component.

13. The assembly of claim 1, wherein the sight member comprises a vertically adjustable elevation component.

14. A firearm comprising the foldable iron sight assembly of claim 1.

15. A method of operating a foldable backup iron sight assembly for a firearm, comprising:

securing the assembly of claim 1 to a rail of a firearm;

applying a force to a side of the sight member in order to compress the biasing element and unlock the sight member; and rotating the unlocked sight member to a raised or lowered locked position.

16. The method of claim 15, wherein step (b) comprises applying a force of about 7 pounds to about 11 pounds.

17. A foldable iron sight assembly for a firearm, comprising:

a rail mount comprising a base, a clamp, a rail pin, and a base locking portion;

a sight member comprising a sight member locking portion rotatably connected to the base locking portion, wherein the base locking portion and the sight member locking portion are configured to interlock with each other; and a locking mechanism comprising an axle and a biasing element, wherein the sight member is rotatable between a locked raised position and a locked lowered position when a force applied to the sight member compresses the biasing element; and wherein the base locking portion comprises a slot configured to receive a lower portion of a slot pin, wherein the slot and slot pin extend radially with respect to the axle, and the slot aligns with a hole that extends longitudinally into a lower end of the sight member and is configured to receive an upper portion of the slot pin.

18. A firearm comprising the foldable iron sight assembly of claim 17.

* * * * *